US007808437B2

(12) United States Patent
Ying

(10) Patent No.: US 7,808,437 B2
(45) Date of Patent: Oct. 5, 2010

(54) ANTENNA ARRANGEMENT

(75) Inventor: Zhinong Ying, Lund (SE)

(73) Assignee: Sony Ericsson Mobile Communications AB, Lund (SE)

( * ) Notice: Subject to any disclaimer, the term of this patent is extended or adjusted under 35 U.S.C. 154(b) by 555 days.

(21) Appl. No.: 11/720,634

(22) PCT Filed: Dec. 2, 2005

(86) PCT No.: PCT/EP2005/056425

§ 371 (c)(1),
(2), (4) Date: Nov. 14, 2007

(87) PCT Pub. No.: WO2006/061352

PCT Pub. Date: Jun. 15, 2006

(65) Prior Publication Data

US 2008/0252538 A1 Oct. 16, 2008

(30) Foreign Application Priority Data

Dec. 7, 2004 (EP) ..... 04028916

(51) Int. Cl.
*H01Q 1/24* (2006.01)
*H01Q 1/38* (2006.01)
*H01Q 13/10* (2006.01)

(52) U.S. Cl. ..... 343/702; 343/700 MS; 343/767

(58) Field of Classification Search ..... 343/700 MS, 343/702, 767, 846, 848, 893
See application file for complete search history.

(56) References Cited

U.S. PATENT DOCUMENTS

| | | | | |
|---|---|---|---|---|
| 6,424,300 | B1 | 7/2002 | Sanford et al. | |
| 6,535,167 | B2 * | 3/2003 | Masuda et al. | 343/700 MS |
| 6,774,850 | B2 * | 8/2004 | Chen | 343/700 MS |
| 7,081,854 | B2 * | 7/2006 | Ying et al. | 343/702 |
| 7,319,432 | B2 * | 1/2008 | Andersson | 343/702 |
| 2002/0135525 | A1 | 9/2002 | Ikegaya et al. | |

FOREIGN PATENT DOCUMENTS

| | | |
|---|---|---|
| EP | 1 359 638 | 11/2003 |
| WO | 01/47059 | 6/2001 |

OTHER PUBLICATIONS

International Search Report for corresponding Application No. PCT/EP2005/056425 mailed Mar. 10, 2006.

* cited by examiner

*Primary Examiner*—Shih-Chao Chen
(74) *Attorney, Agent, or Firm*—Renner, Otto, Boisselle & Sklar, LLP

(57) ABSTRACT

An antenna arrangement comprising a multi-layer PCB (10) with a ground plane (20) in a first layer and a first antenna (11) in a second layer, and an extended ground plane (20) connected to the ground plane of the PCB. A second antenna (110, 120, 130, 140, 150) is formed integral with the extended ground plane (20). The extended ground plane is positioned opposite the first antenna.

15 Claims, 3 Drawing Sheets

ANTENNA ARRANGEMENT

TECHNICAL FIELD OF THE INVENTION

The present invention relates to an antenna arrangement comprising a first and a second antenna.

DESCRIPTION OF RELATED ART

A radio communication apparatus, such as a mobile telephone, requires an antenna for establishing and maintaining a radio link with another unit in a communication system. In the telecommunication industry, the demand for mobile telephones that are small in size, light in weight, and inexpensive to manufacture are continuously present. To this end, printed built-in antennas are utilized for mobile telephones within the 300-3000 MHz frequency range. Printed built-in antennas known in the art comprise microstrip patch antennas and planar inverted-F antennas (PIFA).

As the mobile telephones become smaller and smaller, both conventional microstrip patch and PIFA antennas are too large to fit within the chassis of the mobile telephone. This is particularly problematic when the new generation of mobile telephones needs multiple antennas for cellular, wireless local area network, GPS and diversity.

The antenna pattern of different antennas according to the above is printed on a support member separated from the main printed circuit board (PCB) of the mobile telephone. After manufacturing, the antenna can be connected to the PCB by utilizing connectors, such as pogo-pins. As the need for different communication capabilities increases, the number of components within the chassis of the mobile telephone increases, which is a problem when space within the chassis is scarce.

Furthermore, if the built-in antennas known in the art are assembled by connectors, both the connectors and the assembling of the antenna and the PCB add costs to the mobile telephone. Also, the mechanical tolerances involved in the assembling of the built-in antenna and the PCB may effect the performance of the antenna negatively. That is, it is difficult to obtain exactly the same position of the antenna in relation to the signal source, and sufficient connection of the pogo-pins. Also, in antenna configurations known in the art, the space between the antenna and the PCB is not utilized effectively.

As it becomes more and more common with multi-port antennas in radio communication apparatuses, i.e. antennas having separate antenna arms for each Rx (receiver unit) and Tx (transmitter unit), the number of connectors is increasing and consequently the cost and the problem with mechanical tolerances.

Furthermore, an antenna for applications other than communication with the communication network, such as a GPS antenna may be needed in the radio communication apparatus. Such an antenna may be provided as an additional standalone antenna, such as a ceramic antenna, provided within or external to the chassis of the radio communication apparatus.

EP-A-1,359,638 discloses an antenna printed on a PCB (Printed circuit Board) of a communication apparatus operative in e.g. a GSM (Global System for Mobile communications) and a DCS (Digital Cellular System) communication network. The PCB also comprises a ground plane in one of its layers. An extended ground plane is positioned opposite the antenna pattern and spaced apart from the PCB for improving the radiation characteristics of the antenna. The extended ground plane is connected to the ground plane of the PCB.

SUMMARY OF THE INVENTION

It is an object of the invention to provide an antenna arrangement with increased communication capabilities compared to the prior art.

According to a first aspect, the object is achieved by an antenna arrangement, comprising a multi-layer printed circuit board comprising a ground plane; a first antenna comprising a printed trace of conducting material integrated into the multi-layer printed circuit board; and an extended ground plane positioned opposite the first antenna and connected to the ground plane of the multi-layer printed circuit board. A second antenna positioned in connection with the extended ground plane.

The second antenna may cooperate with the extended ground plane. Furthermore, the second antenna may be formed integral with the extended ground plane.

The first antenna may be operative in at least a first frequency band and the second antenna may be operative in a second frequency band different from the first frequency band.

The second antenna may provide an elliptical polarized radiation pattern. Furthermore, the second antenna may be a right-hand polarized antenna.

The second antenna may be a notch antenna, a slot antenna, or a microstrip antenna.

The second antenna may comprise a matching loop for matching the input impedance of the second antenna to the input impedance of circuitry to which it is connected.

The second antenna may comprise a first and second connection point positioned at a first and a second side of the notch or slot, a connection device operative to inter-connect the first and second connection point thus forming together with the notch or slot the matching loop. The area of the matching loop may set the input impedance of the second antenna.

The first antenna and the second antenna may comprise at least one connection point each, which are separated, the connection point of the first antenna may be positioned at a base of the extended ground plane and the second antenna, and the connection point thereof may be located at an upper portion of the extended ground plane.

The second antenna may be located at an upper portion of the extended ground plane.

The antenna arrangement may comprise a filter tuned to pass signals received by the second antenna.

The second antenna may be formed integral with a conducting sheet of the extended ground plane.

The second antenna may be a GPS antenna.

According to a second aspect, the object is achieved by a communication apparatus comprising an antenna arrangement according to the invention.

The communication apparatus may be a portable radio communication equipment, a mobile radio terminal, a pager, a communicator, an electronic organizer, or a smartphone. Furthermore, the communication apparatus may be a mobile telephone.

Further embodiments of the invention are defined in the dependent claims.

It is an advantage of the invention that the communication capabilities are increased at a low cost. It is a further advantage that the antenna arrangement is highly integrated, wherein assembling tolerances are easily obtained and the production cost is kept low. Also, it is an advantage that components associated with the first antenna may be utilized for providing the second antenna.

It should be emphasized that the term "comprises/comprising" when used in this specification is taken to specify the presence of stated features, integers, steps or components but does not preclude the presence or addition of one or more other features, integers, steps, components or groups thereof.

BRIEF DESCRIPTION OF THE DRAWINGS

Further objects, features, and advantages of the invention will appear from the following description of several embodiments of the invention, wherein various aspects of the invention will be described in more detail with reference to the accompanying drawings, in which.

DETAILED DESCRIPTION OF EMBODIMENTS

Figure 1:
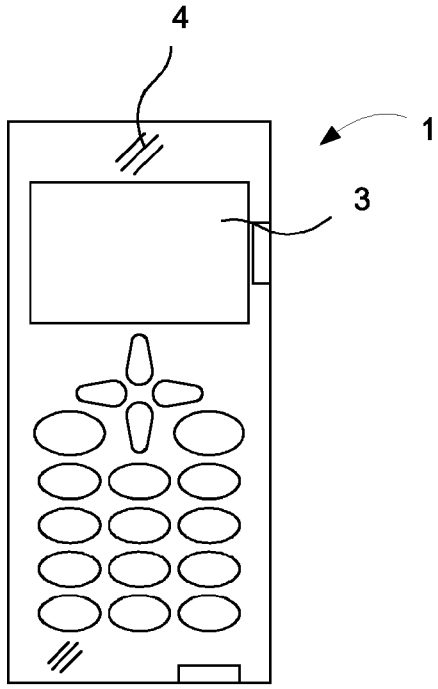
FIG. 1 is a front view of a communication apparatus.

FIG. 1 illustrates a communication apparatus 1 in which an antenna arrangement 2 (FIG. 2) according to the invention may be used as an internal antenna positioned within the chassis of the communication apparatus. To achieve good radiation characteristics when the communication apparatus 1 is used in a talking-position, the antenna arrangement 2, or at least the antennas thereof, is positioned at a top portion of the communication apparatus 1, such as behind a display 3 and/or a loudspeaker 4 thereof. The communication apparatus 1 is exemplified as a mobile telephone in FIG. 1. Other examples of a communication apparatus are a portable radio communication equipment, a mobile radio terminal, a pager, a communicator, an electronic organizer, and a smartphone.

Figure 2A:
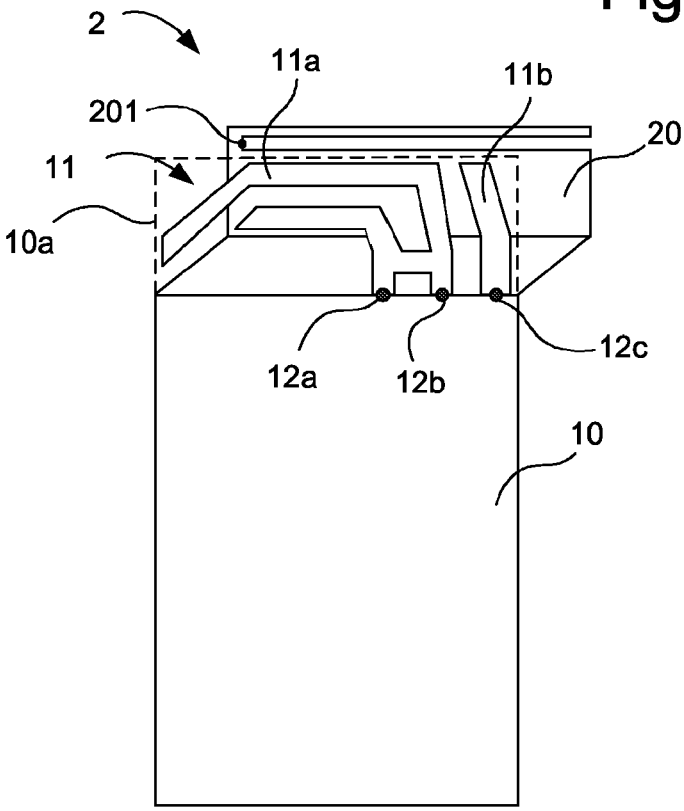
FIG. 2*a* is a front view of one embodiment of an antenna arrangement.
Figure 2B:
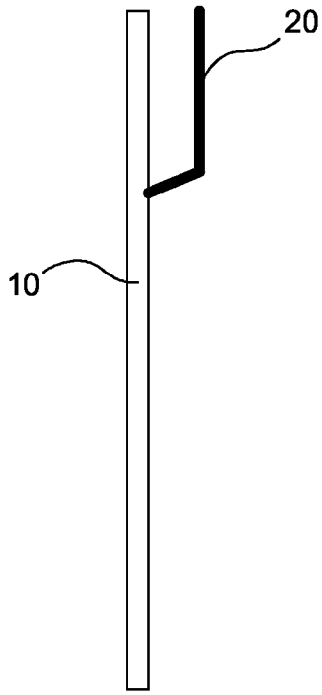
FIG. 2*b* is a side-view of the antenna arrangement of FIG. 2*a;*

FIG. 2*a* illustrates one embodiment of the antenna arrangement 2, which is shown from the side in FIG. 2*b*. The antenna arrangement 2 comprises a multi-layer PCB (Printed Circuit Board) 10 comprising at least a first and a second layer of conducting material. For illustrative purposes, an upper portion 10*a* of the PCB 10 is shown with dotted lines. A first antenna 11 is provided as a printed trace in the first layer, and a ground plane is provided in the second layer. Alternatively, the first antenna 11 is provided in a plurality of layers, e.g. if the first antenna 11 has a plurality of antenna arms. However, several antenna arms may be provided in the same layer. In FIG. 2*a*, the first antenna 11 comprises a first antenna arm 11*a* and a second antenna arm 11*b*. The first antenna arm 11*a* is configured for resonance in a first and a second frequency band, such as the GSM 900 and 1800 MHz frequency bands. The second antenna arm 11*b* may be adapted for resonance in a third frequency band, such as the 1900 MHz PCS (Personal Communication Services) frequency band. The patterns of the antenna arms 11*a,* 11*b* shown in FIG. 2*a* are only for illustrative purposes, and have to be designed for each particular implementation. The first and the second arms 11*a*, 11*b* are connected to a feeding device, such as a coaxial cable, at connection points 12*a*, 12*b*, 12*c*.

An extended ground plane 20 is positioned opposite the first antenna 11 and connected to the ground plane of the PCB 10. The extended ground plane 20 is provided to improve the radiation characteristics of the first antenna 11. To obtain good radiation characteristics, the PCB 10 and the extended ground plane are spaced apart, e.g. by a distance in the range of 6-10 mm. However, the distance may be different and has to be tested and evaluated for each implementation. The extended ground plane 20 may be planar and have a rectangular shape. Alternatively, the extended ground plane 20 may have a different shape, e.g. it may conform to the shape of the first antenna 11, as long as it is sufficiently large to provide the desired radiation characteristics. Also, the extended ground plane 20 need not be planar. For example, the extended ground plane 20 may be convex or concave, or a combination of planar, concave and convex. Thus, the extended ground plane 20 may conform to the shape of the housing of the communication apparatus 1.

Connection points 12*a*, 12*b*, 12*c*, may be positioned at the base of the extended ground plane 20, wherein the extension of the extended ground plane 20 covers the extension of the conductive pattern of the first antenna 11.

The extended ground plane 20 may be provided by a metal sheet being bent at a lower portion to provide a sufficient distance from the PCB 10. The extended ground plane 20 may be connected to the ground plane of the PCB 20 e.g. by soldering.

In another embodiment, the extended ground plane 20 comprises a non-conducting material having a sheet of conducting material provided at least on one side thereof, such as the side facing the PCB 10. The conducting sheet may e.g. be provided by a conducting flexible film, an etching technique, or by a printing technique wherein ink comprising conductive particles are printed on the non-conducting material, such as by screen-printing or tampon printing. To further increase the radiation characteristics, a second sheet of conducting material may be provided on the other side of the non-conducting material, wherein a multi-layer extended ground-plane is provided.

The invention is based on the insight that the extended ground plane 20 of the first antenna 11 may be used for a second antenna. Thus, only a few additional components within the chassis of the communication apparatus 1 are needed for the second antenna, as components of the first antenna 11 are utilized for providing the second antenna, whereby it will be very cheap to provide also the second antenna. The second antenna may e.g. be a notch antenna or a slot antenna, which may be integrated with the extended ground plane. These types of antennas are provided as cut-outs in a ground plane, such as the extended ground plane.

A notch and a slot antenna have nearly circular polarized uniform radiation pattern, which is also known as an elliptical radiation pattern. The radiation pattern may be right-hand or left-hand polarized as described below. A notch or slot antenna, may be used for providing a GPS antenna in the 1500 Mhz frequency band (around 1575 MHz). Other frequency bands are also possible depending on the length of the notch or slot.

FIGS. 3*a*-3*e* illustrate embodiments of the second antenna 110, 120, 130, 140, 150 positioned in connection with the extended ground plane 20, with which it cooperates. In FIGS.

3*a*-3*e*, the extended ground planes are formed integral with the extended ground plane and are illustrated from the side facing away from the PCB 10.

Figure 3A:
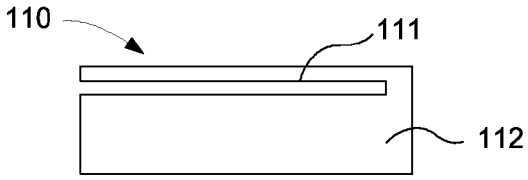
FIGS. 3*a*-3*e* are front views of embodiments of the extended ground plane and the second antenna.

In the embodiment of FIG. 3*a*, the second antenna is a notch antenna 110 with a rectilinear notch 111. Notch 111 is extending in a transversal direction of the extended ground plane 112.

Figure 3B:
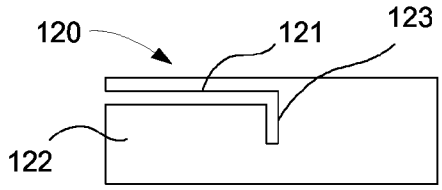

In the embodiment of FIG. 3*b*, the second antenna is a folded notch antenna 120. A first rectilinear portion 121 of the notch of the folded notch antenna 120 extends in a mainly transversal direction of the extended ground plane 122 and a second rectilinear portion 123 thereof in a mainly longitudinal direction.

Figure 3C:
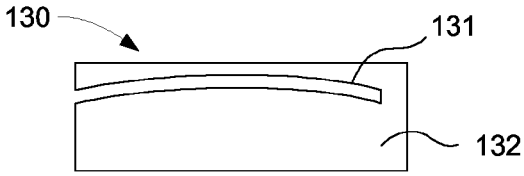

In the embodiment of FIG. 3*c*, the second antenna is a notch antenna 130 with a notch 131 having an arcuate shape. Notch 131 is extending in a mainly transversal direction of the extended ground plane 132.

Figure 3D:
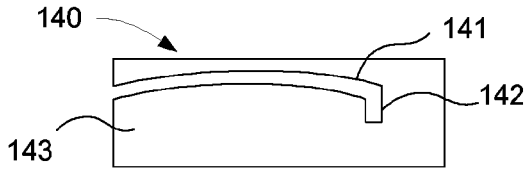

In the embodiment of FIG. 3*d*, the second antenna is a folded notch antenna 140 having a first arcuate portion 141 and a second rectilinear portion 142. The first portion 141 extends in a mainly transversal direction of the extended ground plane 143 whereas the second portion 142 extends in a mainly longitudinal direction.

Figure 3E:
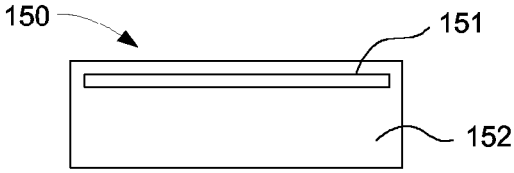

In the embodiment of FIG. 3*e*, the second antenna is a slot antenna 150 with a rectilinear slot 151 extending in a transversal direction of the extended ground plane 152. Alternatively, slot 151 may have a different shape, such as an arcuate shape, and it may extend in a different direction, depending on the desired polarization of the antenna.

FIGS. 3*a*-3*e* illustrate various shapes of the second antenna. The shape is not limited to the shapes shown but has to be tested and evaluated for each particular implementation. For example, the length of the notch or slot sets the wavelength of signals for which the second antenna is tuned to receive and/or transmit. For a notch antenna, the length of the notch from its opened end to its closed end should equal ¼ wavelength, whereas for a slot antenna the length of the slot from one end to the other should equal ½ wavelength. Furthermore, the width of the notch or slot sets the bandwidth of the antenna. The wider the slot or notch the wider bandwidth. Also, the shape of the extended ground plane 20, i.e. whether it is planar or has a convex/concave shape, may have an impact on the radiation characteristics, and thus the form of the notch or slot has to be adapted to it.

Figure 4A:
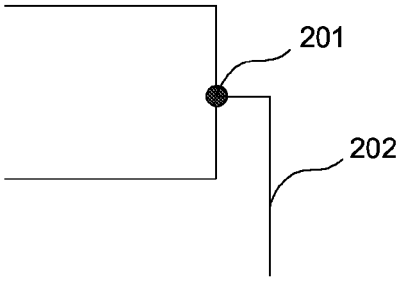
FIGS. 4*a*-4*b* are front views of the connection of the second antenna to a connection device.
Figure 4B:
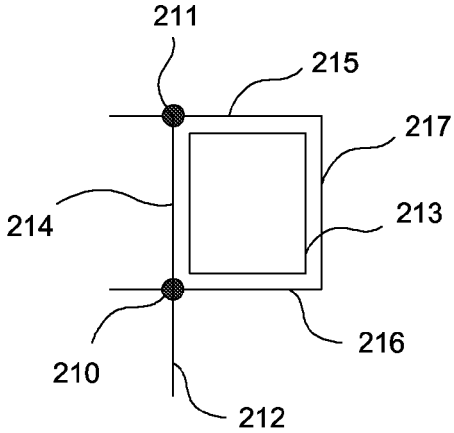

In other embodiments, the shape of the second antenna is circular, elliptical, circular with a tab, square, and/or have a shape being a combination thereof. FIGS. 4*a*-4*b* illustrate embodiments for feeding the second antenna. If the slot or notch is fed at the rightmost end in FIGS. 3*a*-3*e*, the second antenna will be operative for nearly right-hand polarized signals. However, if the notches were reversed, i.e. open at the rightmost edge of the extended ground plane in FIGS. 3*a*-3*d*, and fed at the leftmost end of the slot or notch, the second antenna would be operative for nearly left-hand polarized signals. In the embodiment of FIG. 4*a*, the second antenna has a connection point 201 at the closed end of the notch, or at one of the ends of a slot antenna. An antenna connection device 202 is operative to connect the connection point 201 to a receiver and/or a transmitter of the communication apparatus 1. The connection device 202 may e.g. be a coaxial cable. To match the input impedance of the second antenna according to FIG. 4*a* to the input impedance of the circuitry to which it is connected, a matching device may have to be connected in the feeding path between connection point 201 and the circuitry to which the connection device 202 is connected.

In the embodiment of FIG. 4*b*, the second antenna comprises a first and a second connection point 210, 211. The first and the second connection point 210, 211 are positioned on opposite sides of the longer sides of the notch or slot. If the second antenna is a notch antenna, of any shape, the connection points 201, 202 are positioned nearer the closed end than the opened end of the notch. If it is a slot antenna, the connection points 210, 211 are positioned closer to one of the ends of the slot. An antenna connection device 212 is operative to connect not only the first and the second connection point 210, 211 to the transmitter/receiver of the communication device 1, but also to inter-connect the first and the second connection point 210, 211. Thus, a matching loop 213, illustrated by line 213, is formed by a section 214 of the connection device connecting connection points 210 and 211, portions 215 and 216 of the notch or slot located between connection points 210 and 211 and the closed end of the notch or slot, and the closed end 217 of the slot. The area of the matching loop 213 sets the input impedance of the second antenna. Thus, in the embodiment of FIG. 4*b* the second antenna may have an input impedance which is matched by the matching loop 213 to the input impedance of the circuitry of the communication apparatus, such as 50Ω, to which it is connected. Feeding the second antenna as in FIG. 4*b* is an advantage, as a separate input impedance matching device need not be provided. When determining the length of the notch or slot in the embodiment of FIG. 4*b* for tuning it to a desired wavelength, it should be determined from the opening of the notch, or the end most distant from the connection device 212 if it is a slot antenna, to the connection device 212.

Figure 5:
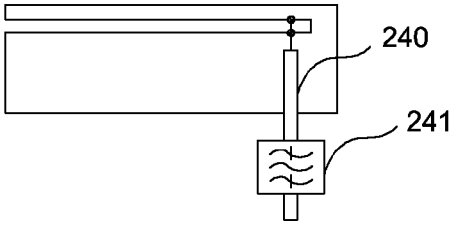
FIG. 5 is a front-view of the second antenna connected to a filter.

FIG. 5 illustrates a connection device 240, e.g. a coaxial cable, connected to a notch antenna through a filter 241. The filter may e.g. be a bandpass filter, a lowpass filter, a highpass filter, or a channel filter, which is tuned to pass signals having a frequency to which the second antenna is tuned. The type of filter is dependent on the frequency ranges of signals for which the first antenna 11 and the second antenna are operative. If the first antenna 11 and the second antenna are tuned to frequency ranges that are relatively close, the filter may be needed. This is e.g. dependent on the sensitivity of the receiver to which the second antenna is connected.

The need for the filter 241 is decreased the further away the connection points 12*a*, 12*b*, 12*c* of the first antenna 11 are from the connection point(s) 201, 210, 211 of the second antenna. If the connection points 12*a*, 12*b*, 12*c* of the first antenna 11 are provided at the base of the extended ground plane 20, and the connection point(s) 201, 202, 203 of the second antenna are provided at an upper portion, such as above the middle of the extended ground plane as from the connection to the PCB 10 to the top thereof, the need for the filter 241 may be eliminated. If the connection point(s) 201, 202, 203 are provided at a top portion of the extended ground plane 20, such as in the embodiments of FIGS. 3*a*-3*e*, the isolation between the first and the second antenna is even further improved, wherein a receiver that is more sensitive to noise may be used without the need for the filter 241. This is an advantage, as a cheaper receiver may be utilized. Furthermore, to increase the isolation between the first and second antenna even further, the connection points 12*a*, 12*b*, 12*c*, of the first antenna 11 and the connection point(s) 201, 202, 203 of the second antenna may be provided at diagonal positions of the extended ground plane, e.g. as is illustrated in FIG. 2*a*.

Figure 6A:
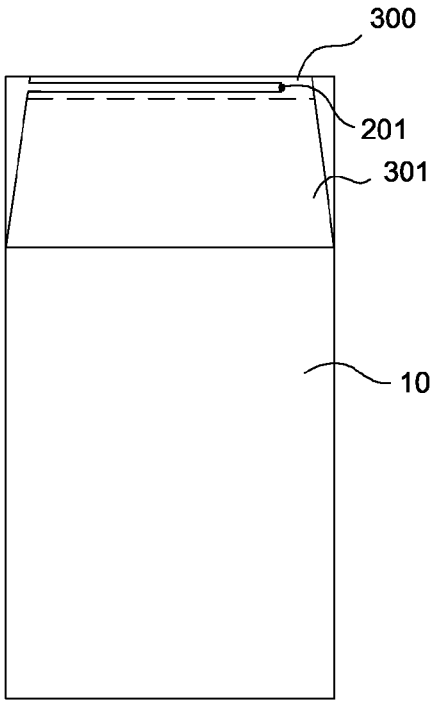
FIG. 6*a* is a front-view of an alternative embodiment of the antenna arrangement.
Figure 6B:
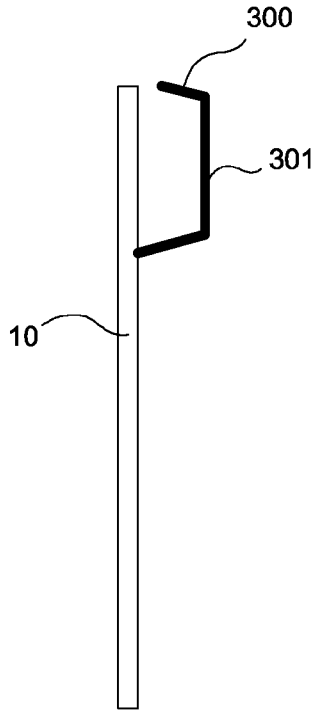
FIG. 6*b* is a side-view of the antenna arrangement of FIG. 6*a;*

FIGS. 6*a* and 6*b* illustrate an embodiment wherein the connection points of the first antenna 11 and the connection point of the second antenna 210 are even further separated. The connection point of the first antenna 11 are provided at the base of the extended ground plane, as is illustrated in FIG. 2*a*. A top portion 300 of the extended ground plane 301 is bent in an angle in relation to an opposing portion 301 of the extended ground plane opposing the first antenna 11. In FIG. 6*b*, the top portion 300 is bent towards the PCB 10. However, the top portion 300 may be bent either towards or away from the PCB 10. The angle between the top portion 300 and the opposing portion 301 is e.g. in the range of 0-90 degrees.

The space between the PCB 10 and the extended ground plane 20 may be utilized for storing components. For example, the space may comprise a loudspeaker and/or a resonance chamber. To effectively conduct acoustic waves, the extended ground plane may comprise one or several recesses.

Figure 7A:
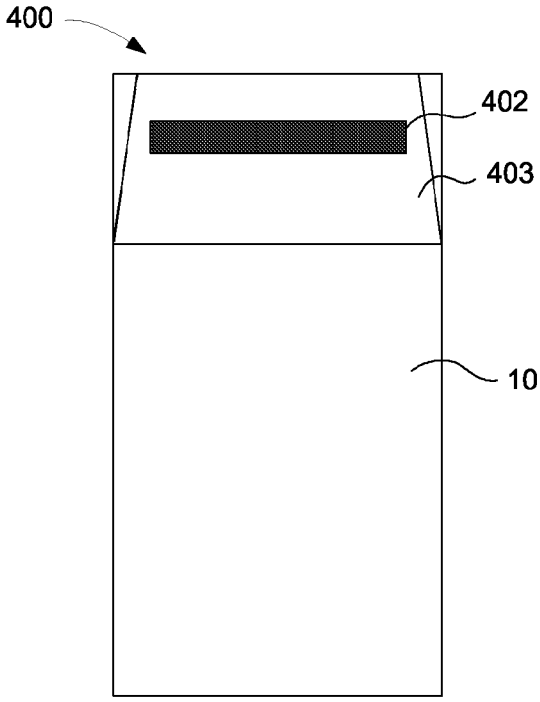
FIG. 7*a* is a front view of an alternative embodiment of the antenna arrangement.
Figure 7B:
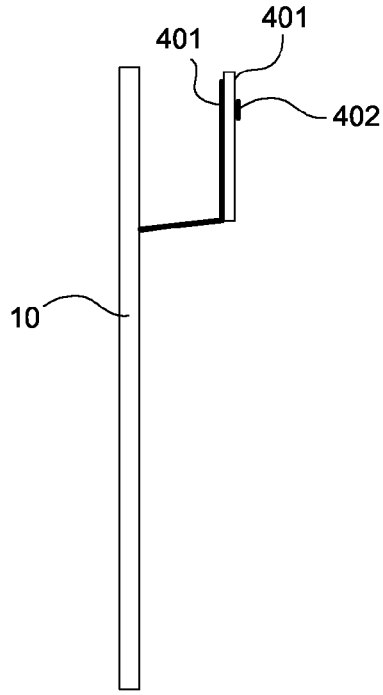
FIG. 7*b* is a side view of the antenna arrangement of FIG. 7*a.*

FIGS. 7*a*-7*b* discloses another embodiment, wherein the second antenna is positioned in connection with the extended ground plane 401. The second antenna 400 is formed integral with the extended ground plane 401, as it requires the ground plane to function properly. In this embodiment, the second antenna is a patch or microstrip antenna, comprising a patch 402, which is positioned above and opposite the extended ground plane 401 with which it cooperates to achieve the desired radiation characteristics. The extended ground plane 401 and the microstrip are provided on a dialectic substrate 403. Alternatively, the extended ground plane 401 is a sheet of metal, which the dielectric substrate is attached to. The patch 402 may then be etched on the dielectric substrate.

The thickness of the substrate may e.g. be in the range of $0.003\lambda_0 \leqq h \leqq 0.05\lambda_0$, where h is the thickness of the substrate and $\lambda_0$ is the free-space wavelength. The first antenna is positioned opposite a first side of the extended ground plane and the patch 402 of the second antenna is positioned opposite a second side of the extended ground plane. The patch 402 and the extended ground plane 401 may be etched, such as photo etched, on the dielectric substrate 403. Patch 402 may be square, rectangular, thin strip (dipole), circular, elliptical, triangular, or any other configuration. The patch 402 may be fed as described above. The bandwidth of the second antenna may be configured as described above with the length and width of the radiating element, i.e. the patch 402.

The present invention has been described above with reference to specific embodiments. However, other embodiments than the above described are possible within the scope of the invention. The features of the invention may be combined in other combinations than those described. The scope of the invention is only limited by the appended patent claims.

The invention claimed is:

1. A communication apparatus comprising:

a multi-layer printed circuit board comprising a ground plane;

a first antenna comprising a printed trace of conducting material integrated into the multi-layer printed circuit board and arranged at an upper portion of said communication apparatus; and an extended ground plane positioned opposite to the first antenna and connected to the ground plane of the multi-layer printed circuit board and conforming to the shape of the first antenna, the extended ground plane and the printed circuit board being spaced apart by a distance and the extended ground plane being connected to the ground plane of the printed circuit board;

wherein a second antenna is integrated with the extended ground plane and located at an upper portion of the extended ground plane.

2. The apparatus according to claim 1, wherein said distance is in the range of 6-10 mm.

3. The apparatus according to claim 1, further comprising:

a connection point of the first antenna, provided adjacent the base of the extended ground plane, and a connection point of the second antenna, provided at an upper portion, such as above the middle of the extended ground plane as from the connection to the printed circuit board to the top thereof.

4. The apparatus according to claim 3, wherein the connection point of the second antenna is provided at a top portion of the extended ground plane.

5. The apparatus according to claim 3, wherein the connection point of the first antenna and the connection point of the second antenna are provided at diagonal positions of the extended ground plane.

6. The apparatus according to claim 1, wherein the first antenna is operative in at least a first frequency band and the second antenna is operative in a second frequency band different from the first frequency band.

7. The apparatus according to claim 1, wherein the second antenna is a notch antenna or a slot antenna.

8. The apparatus according to claim 1, wherein the second antenna comprises a matching loop configured to match an input impedance of the second antenna to an input impedance of a circuitry to which it is connected.

9. The apparatus according to claim 8, wherein the second antenna comprises a first and second connection point positioned at a first and a second side of the notch or slot, and a connection device being operative to inter-connect the first and second connection point thus forming together with the notch or slot the matching loop.

10. The apparatus according to claim 8, wherein an area of the matching loop is configured to set the input impedance of the second antenna.

11. The apparatus according to claim 1, wherein the second antenna is operative in the 1500 MHz frequency band at approximately 1575 MHz.

12. The apparatus according to claim 1, comprising a filter tuned to pass signals received by the second antenna.

13. The apparatus according to claim 1, wherein the second antenna is integrated with a conducting sheet of the extended ground plane.

14. The apparatus according to claim 1, wherein the second antenna is operative in a frequency band of a global positioning system (GPS).

15. The apparatus according to claim 1, wherein the communication apparatus is a portable radio communication equipment, a mobile radio terminal, a pager, a communicator, an electronic organizer, or a mobile telephone.

* * * * *

UNITED STATES PATENT AND TRADEMARK OFFICE

CERTIFICATE OF CORRECTION

PATENT NO. : 7,808,437 B2
APPLICATION NO. : 11/720634
DATED : October 5, 2010
INVENTOR(S) : Zhinong Ying It is certified that error appears in the above-identified patent and that said Letters Patent is hereby corrected as shown below:

Front Page, Section (60), Related U.S. Application Data should be added:

-- Related U.S. Application Data

(60) Provisional application No. 60/636,576, filed on Dec. 16, 2004. --

Signed and Sealed this
First Day of March, 2011

David J. Kappos

David J. Kappos
*Director of the United States Patent and Trademark Office*

UNITED STATES PATENT AND TRADEMARK OFFICE

CERTIFICATE OF CORRECTION

PATENT NO. : 7,808,437 B2
APPLICATION NO. : 11/720634
DATED : October 5, 2010
INVENTOR(S) : Zhinong Ying It is certified that error appears in the above-identified patent and that said Letters Patent is hereby corrected as shown below:

Col. 1, Line 2 insert

-- CROSS REFERENCE TO RELATED APPLICATION

This application is a §371 of International Application No. PCT/EP2005/056425 filed on December 2, 2005, which claims benefit to U.S. Provisional Application No. 60/636,576 filed on December 16, 2004, and also claims priority to European Application No. 04028916.7 filed on December 7, 2004. --

Signed and Sealed this
Twenty-second Day of November, 2011

David J. Kappos

David J. Kappos
*Director of the United States Patent and Trademark Office*